US006202531B1

(12) United States Patent
Comeyne

(10) Patent No.: US 6,202,531 B1
(45) Date of Patent: Mar. 20, 2001

(54) LAND MINE KILLER

(75) Inventor: William G. Comeyne, Montclair, VA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/389,558

(22) Filed: Sep. 3, 1999

Related U.S. Application Data

(66) Substitute for application No. 09/301,742 on Feb. 27, 1998, now abandoned.

(51) Int. Cl.[7] ..... F42B 12/02
(52) U.S. Cl. ..... 89/1.13
(58) Field of Search ..... 89/1.13; 102/403, 102/389, 393, 402

(56) References Cited

U.S. PATENT DOCUMENTS 3,724,319 * 4/1973 Zabelka et al. ..... 89/1 M
4,210,082 * 7/1980 Brothers ..... 102/8
5,237,929 * 8/1993 Ekholm ..... 102/476
5,365,852 * 11/1994 Bender et al. ..... 102/476
5,540,156 * 7/1996 Fong ..... 102/476
5,619,008 * 4/1997 Chawla et al. ..... 102/310
5,753,851 * 5/1998 Jordan et al. ..... 102/427
5,792,980 * 8/1998 Weimann ..... 102/476
5,939,663 * 8/1999 Walters ..... 102/476

* cited by examiner

*Primary Examiner*—Michael J. Carone
*Assistant Examiner*—Troy Chambers
(74) *Attorney, Agent, or Firm*—Milton W. Lee; John E. Holford; Alain L. Bashore

(57) ABSTRACT

A mine destroyer round in the shape of a hollow aerodynamic disk containing explosively formed projectiles that fire toward the ground. A powered means such as a catapult or a mortar tube containing a contact explosive is used to launch the round over a mine field.

12 Claims, 5 Drawing Sheets

LAND MINE KILLER

RELATED APPLICATION

This is a Substitute Application for patent application Ser. No. 09/031,742, filed Feb. 27, 1998, now abandoned.

DESCRIPTION

BACKGROUND OF THE INVENTION

1. Field of the Invention

The present invention generally relates to methods and devices for clearing combat areas of unexploded mines and other munitions.

2. Description of the Prior Art

Recently, there has been a proliferation of land mines and armed munitions with faulty fuzes in certain countries which presents a considerable hazard to travelers, animals and particularly small children. As yet these objects contain no self-destruct capability. The largest population of mines are of the anti-personnel type, which more often maim than kill. Though less in number, anti-tank mines and unexploded bombs present a greater problem to vehicular traffic and most importantly to large and costly mine removal equipment. The easiest method of removing anti-personnel mines is a lightly armored rake, that does not have to penetrate deeply into the ground. This, however is much too dangerous when more deeply buried anti-tank mines, some using shaped charges, are also present. Another proposed method is to attach hundreds of explosive charges to a large net, which can then be deployed over a large area in a mine field. The charges each have a fuse interconnected electrically or pyrotechnically to the other fuzes, so that the charges reinforce one another in destroying surface and buried mines. This approach requires very specialized deployment vehicles and tends to be cumbersome, expensive and slow. There has been some success in mapping mine fields with radar, but there is a need for a safe means to use this information

SUMMARY OF THE INVENTION

The present invention proposes the use of a large number of special gliding saucer-like Mine Killer (MK) rounds with large diameters that can be safely delivered over a predetermined central point in a large target area within a mine field. These in turn carry smaller diameter explosively-formed-projectiles (EFP's) directed toward smaller mutually exclusive target areas of the large area. The MK rounds may include means to vary the spacing between the EFP's and at least some of the EFP's must have the capability of penetrating the ground to a depth of several feet to destroy antitank mines.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
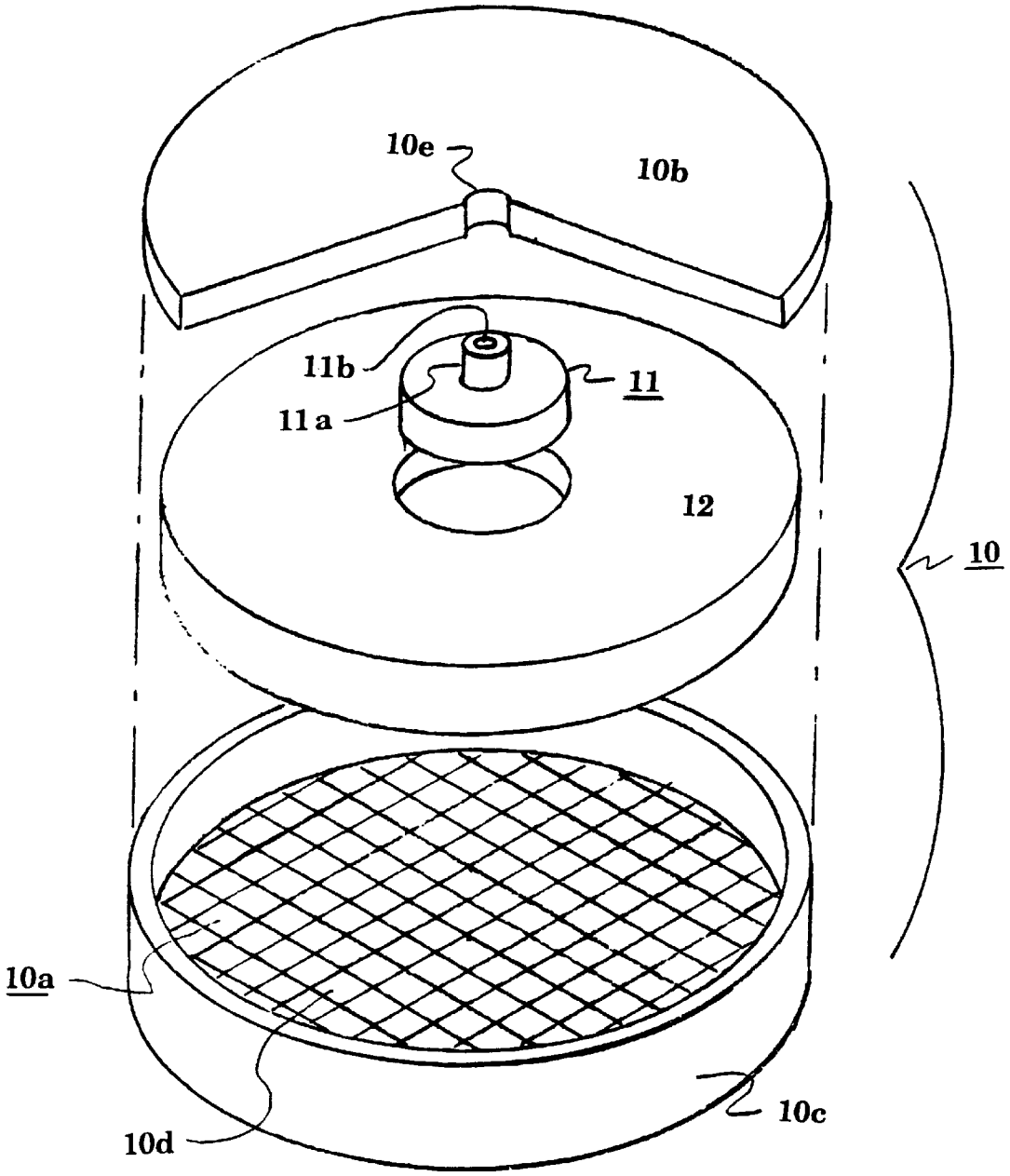
FIG. 1 shows an isometric view of a Mine Killer round with an explosive filled body, a part of which breaks into explosive formed projectiles (EFP's)

Referring again to the drawings, and more particularly to FIG. 1, there is shown an isometric view of one embodiment of an MK round according to the present invention. This round 10 has a hollow disk shaped body defined by a broad circular bottom plate 10*a*, a similar top plate 10*b* and a toroidal sidewall 10*c*. The bottom plate is grooved to define explosively formed projectiles (EFP) 10*d*, that fire away from the thicker opposite ungrooved top plate of the body when a fuze 11 detonates an explosive charge 12 inside the body. The fuze, similar to many available for artillery, incorporates a time delay that allows the round to just reach its destination in the mine field before detonating the charge. The top plate defines an aperture 10*e* to receive a stem 11*a* projecting axially from the fuze. The time is set through this stem by mechanical or electrical timing mechanisms well known in the art. If the timing mechanism is mechanical, the stem will be shaped to receive a timing tool, such as an Allen head wrench. If the timing mechanism is electrical, one or more contacts 11*b* are exposed at the end of the stem to receive electrical timing signals. If the fuze does not include a firing squib, as will be shown in FIG. 2, contacts to fire external squibs may also be provided on the stem or inside the round. Also, like artillery fuzes, it may be armed at its launch, when set back and spin are detected. The EFP's may have different shapes, such as the thin square projectile 10*d*, that can slide or roll over the ground surface in search of anti-personnel mines; or sharp missiles, to be discussed at FIG. 2, that penetrate several feet into the earth in search of anti-tank mines. As long as the round's thickness remains very small compared to its diameter the aerodynamic properties will provide sustained flight when the round is launched nearly parallel to the ground with its axis vertical and with a substantial spin component.

Figure 2:
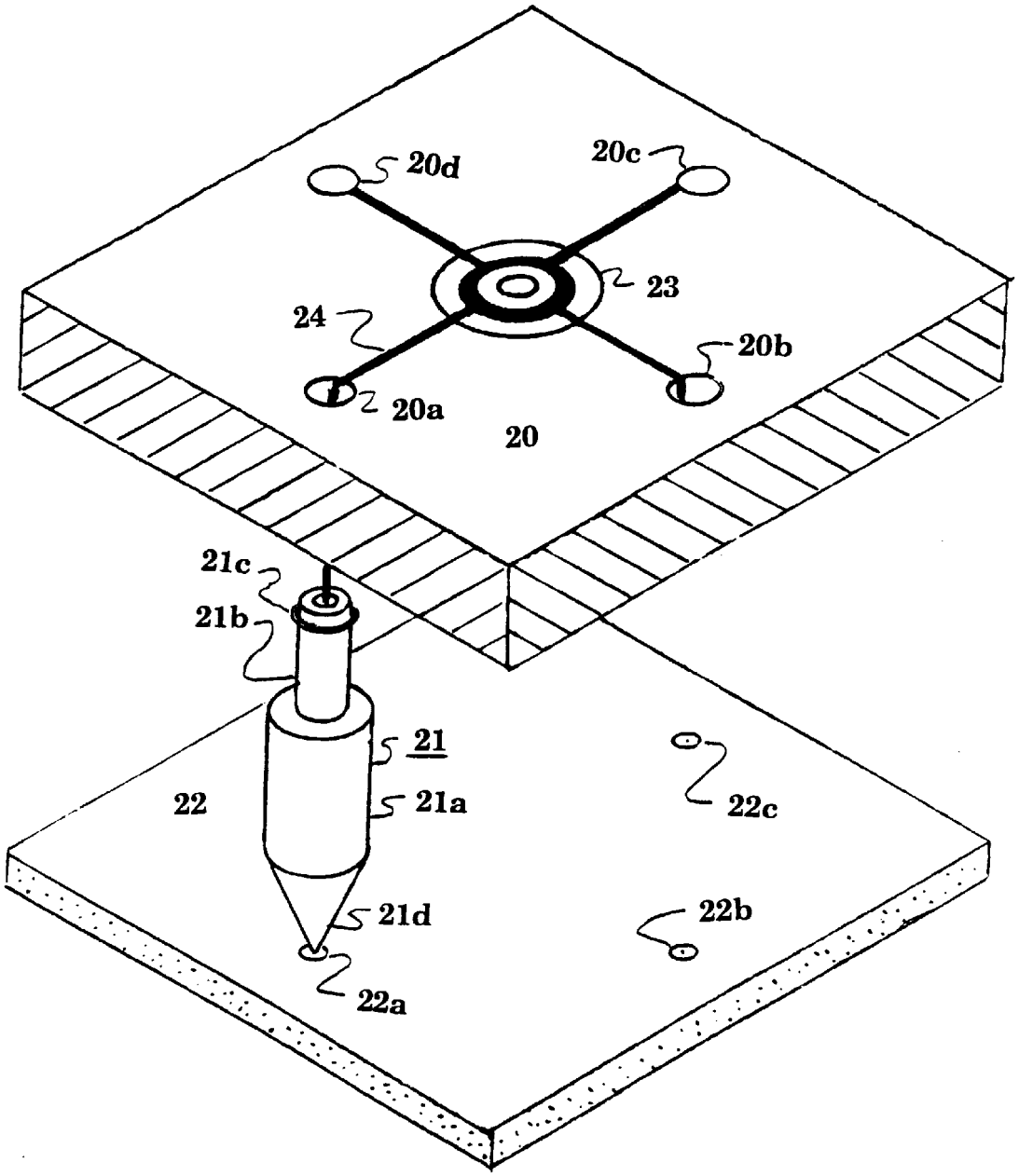
FIG. 2 shows an isometric view of a small center portion of an MK round, with a massive disk shaped top plate, to which individual EFP's are attached, and a frangible bottom plate.

As shown in FIG. 2 the MK round may also have a top plate 20 with EFP apertures 20*a*, 20*b*, etc. Each aperture receives an explosive filled closed metal EFP shell 21 equipped with a firing squib. The EFP shell or cartridge has a large diameter portion 21*a* over most of its length that is too large to fit into the EFP apertures, but it has a small diameter end portion 21*b* that provides a detonating path for the squib and fits snugly into an EFP aperture. The end portion 21*b* may be threaded and terminate flush with the top plate's upper surface, or it may project slightly beyond the top plate and be grooved for a mating retainer ring 21*c* that prevents it from being dislodged during normal handling and launching. The bottom portion 21*d* is shaped according to the type of mine it is to destroy, i.e. pointed for deep mines and blunt for surface mines. The EFP are preferably centered on radii of the body separated by equal angles and form one or more groups wherein the projectiles are equally spaced from the center of the disk. The population of the groups may be proportional to their radial spacing. The apertures 20*a–c* for these EFP cartridges can also slope away from the axis to provide a wider dispersion of EFP's. The bottom wall 22, which extends into the side walls in this arrangement, serves only as an aerodynamic surface and should be made of a thin layer of frangible material such as polystyrene, polystyrene foam or a ceramic. A series of dents or apertures 22*a–c* etc. may be formed in the bottom plate to receive the pointed ends of the cartridges to further stabilize them. Again a time fuze 23 is placed on the top plate of the MK round and supplies a firing signal to all of the squibs. This can occur through an extra firing pin {not shown} on the fuze that contacts an insulated metal spider connector 24. This spider can be a printed circuit or a firing cap and chemical detonating cord, if the fuze has a mechanical timer and mechanical firing pin. The spider may be placed on the bottom side of the top plate provided that the apertures 20*a–c* etc. or the stems 21*b* etc. are modified to provide access to the firing pin. The round's interior can be flooded with foam plastic if desired.

Figure 3:
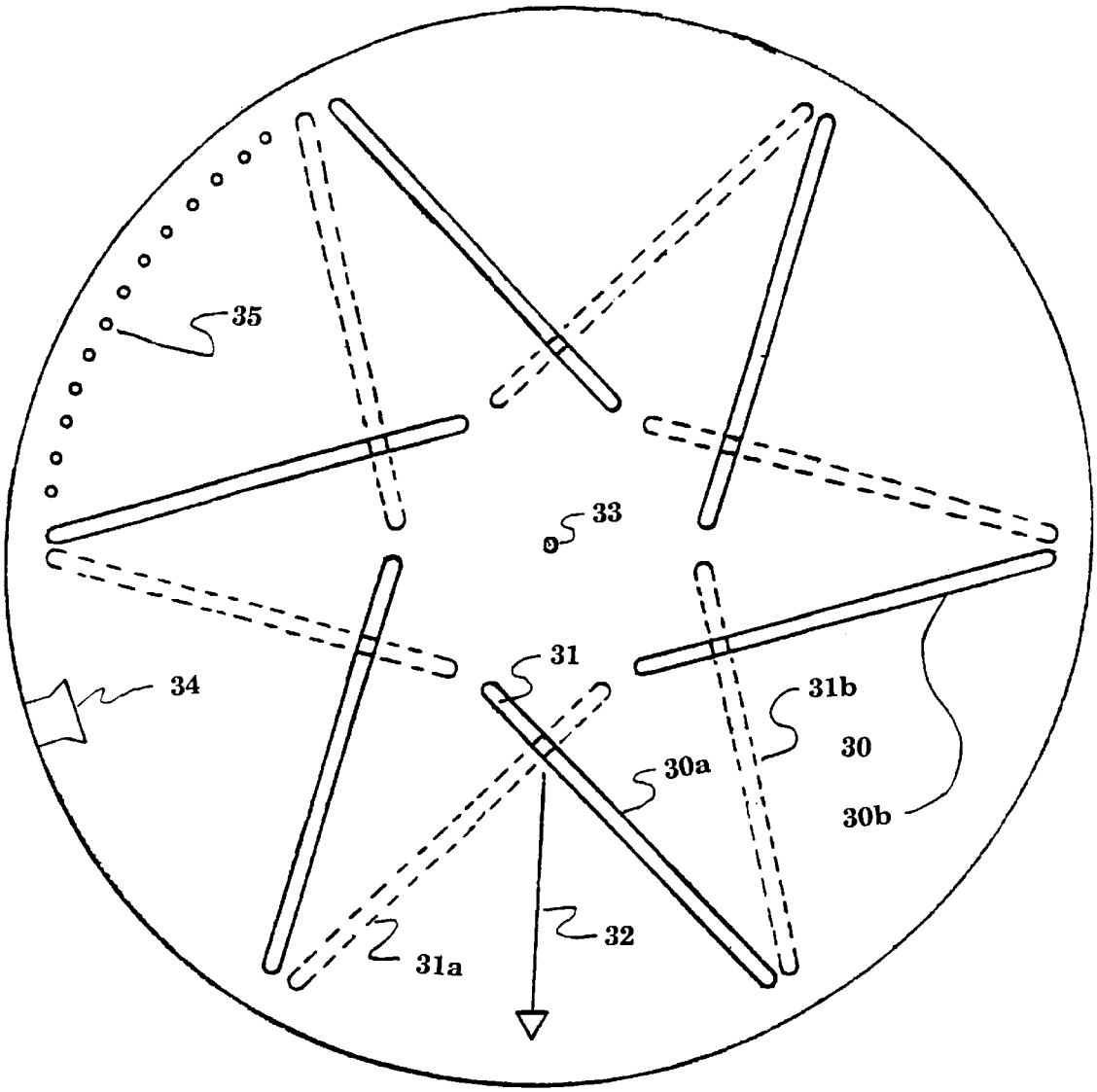
FIG. 3 shows a plan view of two superposed slotted subplates from which the top plate of an MK round in FIG. 2 may be formed, to vary the positions of the EFP's.

FIG. 3 shows a plan view of two subplates 30 and 31 from which the top plate of an adjustable MK round can be made. Each subplate is formed with a pattern of adjustment slots 30*a*, 30*b*, etc. and 31*a*, 31*b*, etc. So that slots 30*a* and 31*a*, 30*b*, 31*b*, and so forth, form pairs that intersect at radials, such as the one indicated by arrow 32. Equal and opposite rotations of the subplates relative to arrow 32 moves the intersection along the arrow. The intersections here are equivalent to the apertures 20*a*–20*d* of FIG. 2. The adjustment slots preferably should intersect nearly normal to define a nearly square intersection. The straight slots shown are a compromise, designed to facilitate fabrication. Curved slots would provide less deviation of the intersection during adjustment of the subplates. A combination of radial and spiral slots also would work well, but these would destroy the symmetry of the subplates. The subplates shown are made identical and simply inverted with respect to the other. The two are then pinned together at their common center 33, for relative rotation by the smallest diameter portion of the fuze. The small diameter end of an EFP, as shown in FIG. 2, is inserted in each slot intersection on the subplates and extends slightly beyond the upper surface of the top plate. The portion of the EFP small diameter end projecting above the top plate is circumferentially grooved, as before, and fixed with a retaining ring. Later the plates may be adjusted and clamped together by a clip 34. Instead of clamping, the plates may be provided with a concentric circle of small closely spaced index holes, like hole 35, which when aligned provide quantized adjustments that are fixed by inserting an index pin (not shown here) through any pair of the aligned holes. The pin could be inserted automatically by an automatic pattern setter in a fully automated mine clearing system.

Figure 4:
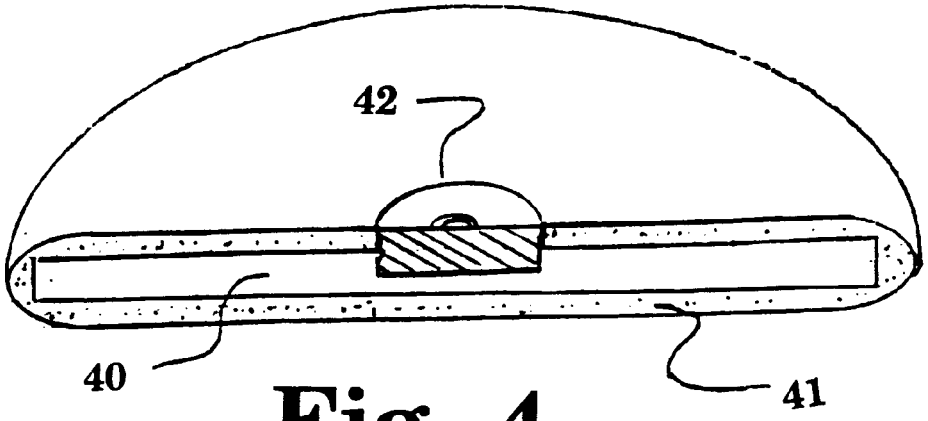
FIG. 4 shows an isometric view of an MK round with a frangible covering added for aerodynamic purposes.

As shown in FIG. 4 a lightweight frangible coating 41 such as plastic foam can be added to any round 40 to provide a shape that enhances the desired its aerodynamic properties and which is easily blown away by the charge. The coating defines an aperture for the fuze 42 or fuze stem, depending on the design of the round. The larger aperture shown allows the fuze to be added after assembly of the rest of the round, which provides added safety. The widest diameter of the fuze may be threaded into the top plate of the round, when the larger aperture is used. To preserve the integrity of the top surface the fuze is raised to the level of the coating.

Figure 5:
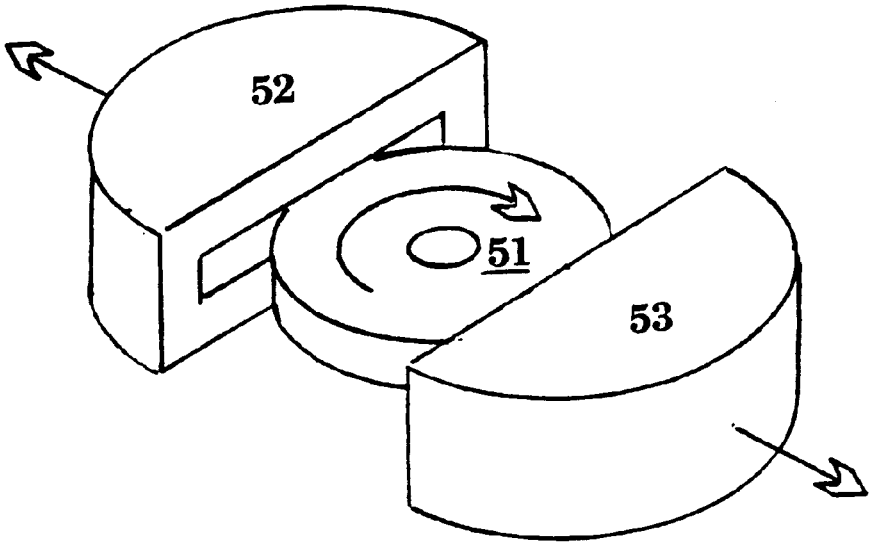
FIG. 5 shows an isometric view of a mortar type launcher with a round bore and an axially split cylindrical sabot for the MK round.
Figure 5:
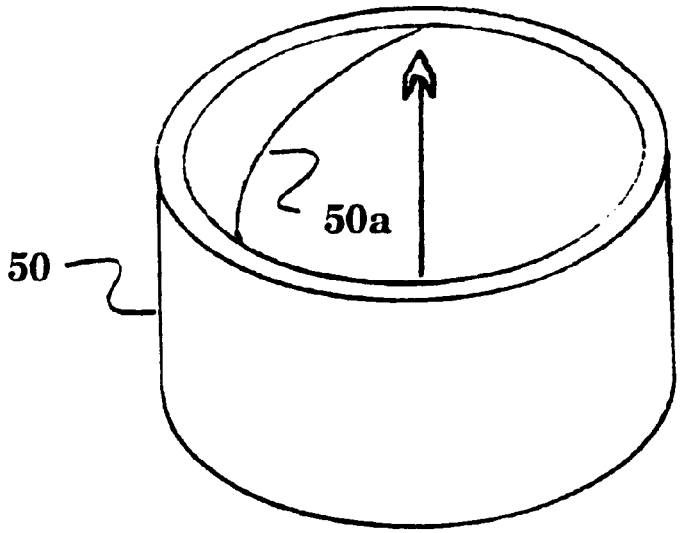

As shown in FIG. 5, a conventional cylindrical mortar type launcher 50 can be used with any MK round 51. To provide small clearances with the mortar tube the round is best encased in an inexpensive lightweight metal or plastic sabot with a smooth cylindrical surface. The sabot is formed from two or more, preferably identical, preformed plastic inserts, such as 52 and 53, each of which has inner contours to match the proximate surface of the round. It may also be desirable in this arrangement to form irregularities in the round's edges to prevent relative rotation between the sabot and the round. The mortar tube includes rifling 50*a* that engages irregularities on the sabot's edges and thus fires the projectile with high spin that keeps its axis nearly vertical. The sabot can also be used as a packing device during shipment. The exposed mating edges of the inserts may be shaped to catch the air and support the centrifugal forces that strip the sabot away from the round as it leaves the launch tube. Launching may accomplished by means of a contact explosive added to the sabot or placed at the bottom of the tube before the round and sabot are dropped in. Insertion of the round can be done manually or, if desired by an automatic feeder, at timed intervals that can insure proper coverage of a mine field.

Figure 6:
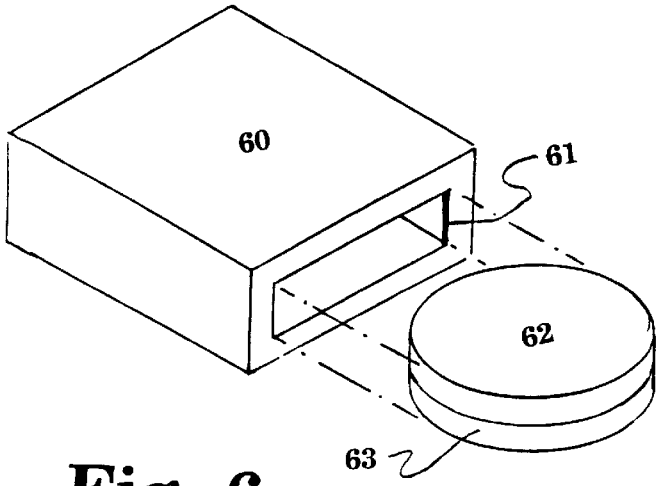
FIG. 6 shows an isometric view of a mortar type launcher with a rectangular bore and a cylindrical sabot split normal to the sabot axis for the MK round.

As shown in FIG. 6, the mortar tube may also be rectangular for horizontal orientation when firing. A rectangular tube 60 with a spin strip 61 of high friction material attached to a small inside surface permits nearly horizontal firing with similar spin and simplifies timing of the projectile fuze. Launching may accomplished by means of an electrically fired explosive inserted in the closed end of the tube before the projectile and sabot. This can then be fired by a firing pin or electrical contacts mounted through the closed end of the tube. If needed, a sabot may be added. This sabot is divided into portions 62 and 63 symmetrical about a plane normal to the axis. This design is more stable in a rectangular tube than the arrangement in FIG. 5. Air resistance is a greater factor in the removal of this sabot, so mass should be kept to a minimum.

Figure 7:
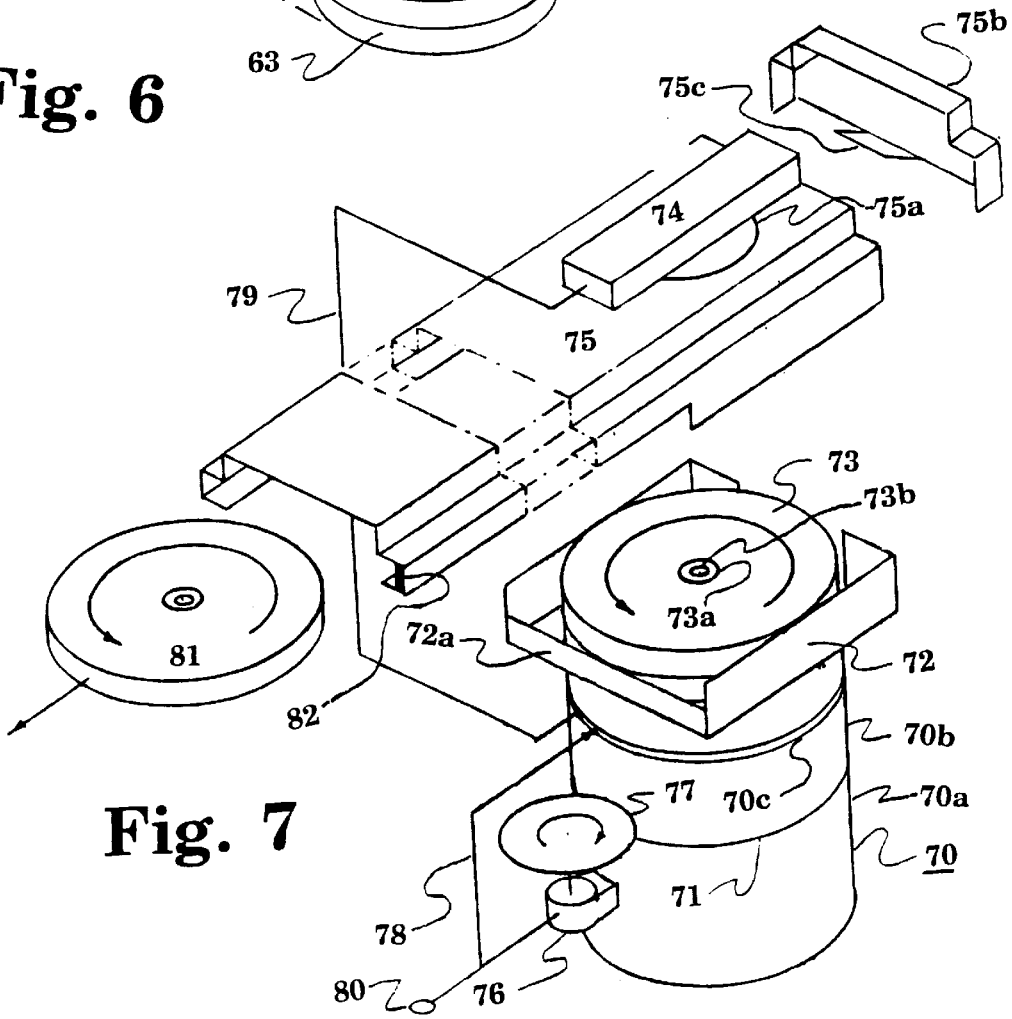
FIG. 7 shows an isometric view of a sling type launcher for the MK rounds.

FIG. 7 shows an exploded view of a sling type launcher, similar to the rectangular mortar tube above, with MK rounds being launched. The MK round is inserted from a feeder tube 70 with a vertical axis. The rounds pass through a rotation joint 71, preferably a type using ball or roller bearings to minimize friction, and into a vestibule 72. The uppermost round 73 has a fuze stem 73*a* that engages a setting tool [not shown] on the bottom of a timer programmer 74. This programmer is mounted on a launch tube 75 over an aperture 75*a* therein. With the vestibule nested into the launch tube 75, this engagement occurs just before the round contacts the top of the launch tube and clears a retaining wall 72*a* on the vestibule. If the round is not preprogrammed, the timing is set either by a precise movement of the stem or, preferably, by a specific pattern of charging current pulses applied to a contact 73*b* on the stem. If the setting tool is purely mechanical, e.g. an Allen wrench, it engages vertical faces of the stem and prevents horizontal movement. The programmer must, in that case, include some means to retract the tool after the timing is set. This is not a problem with electrical fuzes with contacts flush to a flat common fuze and MK round surface. Many mechanical and electrical fuzes timers are set this way and are well known in the ammunition fuzing art. The feeder tube 70 has a fixed portion 70*a* attached to a vehicle or other base. The vestibule is attached to a rotateable portion 70*b* above portion 70*a*. A motor 76 is attached to the fixed portion and drives a coupling 77, e.g. a friction wheel, belt drive or gear set. One or more brush contacts, like contact 78, may be used to supply current to a slip ring, like ring 70*c* on portion 70*b*. A lead, like lead 79, may then connect the slip rings to the programmer, if electronic timers are used. Multiple fuze inputs may be obtained by using annular contacts on the programmer or the fuze that are centered normal to axis of the rotating joint and thus invariant with its rotation. The programmer may store timer information or merely pass on information from a computer or other source through an input socket 80 mounted on the vehicle or other base that supports the launcher. Power for the motor and any tools or other devices used by the launcher may be supplied through this same socket. A short time later, with the end cap 75*b* inserted into the launch tube, the round also depresses a spring tab 75*c* mounted on the end plate. When the round 73 clears retaining wall 72*a*, the spring urges it off-axis into the launch tube where centrifugal forces take over. Round 81 represents a round that was on top of round 73 and emerges with the linear and rotational motions indicated by the arrows thereon, these being initiated through drive 77. The launch tube essentially contacts only the narrow edge wall of the round using a narrow friction strip 82 to impart additional spin during launching. The final target position of the round is determined by the angular position of the launch tube at insertion of the round, the rotation speed of the launch tube and the time fuze setting. This sling launch tube has several advantages over the mortar tube. It is cheaper because it can run off the motor of the launch vehicle with no added launch explosives. This also makes for safer launching. Sabots can employed as was done with the rectangular mortar tube. Variations of the types of round and their parameters provide a wide range of mine clearance scenarios.

Having thus described my invention, what I claim as new and desire to secure by Letters Patent is as follows:

1. A mine killer system including a disk shaped ammunition round for destroying emplaced land mines, said round comprising:

a hollow disk shaped body with a vertical axis of symmetry defined by the axis of a massive rigid circularly cylindrical top plate;

a time delay fuze mounted in the center of said top plate;

a plurality of explosively formed projectiles joined to the bottom of said top plate and oriented to travel away from said plate substantially parallel to the axis of said round;

each of said projectiles having its own charge with a firing squib sealed in a metal shell mounted between said top plate and said projectile; and said fuze being interconnected with said squibs to fire them simultaneously after a predetermined time delay.

2. A mine killer system according to claim 1; wherein:

said disk shaped body is covered with a frangible coating shaped to provide aerodynamic lift and stability to said round, when launched in a direction normal to its axis parallel to the earth and rotating about its axis.

3. A mine killer system according to claim 2; wherein said system further includes:

a powered means to launch said round rotating about its axis, with a component of direction normal to its axis and with its axis normal to the earth.

4. A mine killer system according to claim 1; wherein:

said round consists of two disk shaped plates pinned together at their centers, each of said plates radially defining an equal number of identical pie shaped sectors with each sector including an identical slot sloped with respect to the center radius of said sector;

said disks being inverted to one another and pinned together at their centers, whereby said slots cross to provide a plurality of radially adjustable intersections; and each of said projectiles engaging a different one of said intersections.

5. A mine killer system according to claim 3; wherein:

said launching means is a catapult.

6. A mine killer system according to claim 3; wherein:

said powered means is a mortar tube into which said round is dropped; and a pressure sensitive explosive charge is located at the bottom of said tube that explodes on contact with said round.

7. A mine killer system according to claim 6; wherein:

the inner surface of said mortar tube is round with a rifling groove to spin said round.

8. A mine killer system according to claim 6; wherein:

the inner surface of said mortar tube is rectangular with one of its narrow walls having a greater coefficient of friction than the other to spin said round.

9. A mine killer system according to claim 5; wherein said catapult includes:

a rectangular tube rotated about an axis normal to said tube's broad walls near one end of said tube; and one of said tube's narrow walls has a greater coefficient of friction than the other to spin said round.

10. A mine killer system according to claim 7; wherein:

the outer cross-section of said round is less than the inner cross-section of said tube; and a cylindrical sabot with an outer cross-section equal to said inner cross-section surrounds and firmly engages said round.

11. A mine killer system according to claim 8; wherein:

the outer cross-section of said round is less than the inner cross-section of said tube; and a cylindrical sabot with an outer cross-section equal to said inner cross-section surrounds and firmly engages said round.

12. A mine killer system according to claim 9; wherein:

the outer cross-section of said round is less than the inner cross-section of said tube; and a cylindrical sabot with an outer cross-section equal to said inner cross-section surrounds and firmly engages said round.

* * * * *